US006175071B1

(12) United States Patent
Ito

(10) Patent No.: US 6,175,071 B1
(45) **Date of Patent: *Jan. 16, 2001**

(54) MUSIC PLAYER ACQUIRING CONTROL INFORMATION FROM AUXILIARY TEXT DATA

(75) Inventor: Shinichi Ito, Hamamatsu (JP)

(73) Assignee: Yamaha Corporation, Hamamatsu (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/532,112

(22) Filed: Mar. 21, 2000

(30) Foreign Application Priority Data

Mar. 23, 1999 (JP) ..... 11-076991

(51) Int. Cl.[7] ..... A63H 5/00; G04B 13/00; G10H 7/00

(52) U.S. Cl. ..... 84/609; 84/645

(58) Field of Search ..... 84/609, 645, 610, 84/631; 434/307 A

(56) References Cited

U.S. PATENT DOCUMENTS 5,499,921 3/1996 Sone .
5,542,000 7/1996 Semba .
5,663,515 9/1997 Kato .
5,705,762 * 1/1998 Kang et al. .
5,739,451 * 4/1998 Winksy et al. ..... 84/609
5,765,152 * 6/1998 Erickson .
5,808,223 * 9/1998 Kurakake et al. ..... 84/609
5,854,619 12/1998 Kato .

* cited by examiner

*Primary Examiner*—Jeffrey Donels
(74) *Attorney, Agent, or Firm*—Morrison & Foerster

(57) ABSTRACT

A music apparatus is constructed for providing a music performance according to performance data. In the music apparatus, an input section inputs performance data composed of a header part and a body part containing music sequence data associated to a music performance. A searching section searches the header part of the performance data to find therefrom a keyword. A reading section provides music control information corresponding to the keyword searched from the header part. A generator section processes the music sequence data contained in the body part of the inputted performance data based on the music control information provided from the reading section to thereby output a signal representative of the music performance.

26 Claims, 6 Drawing Sheets

MUSIC PLAYER ACQUIRING CONTROL INFORMATION FROM AUXILIARY TEXT DATA

BACKGROUND OF THE INVENTION

1. Field of the Invention

The present invention relates generally to a performance data processing system and, more specifically, to a performance data processing system for effectively using auxiliary text data or character string information included in performance data.

2. Description of Related Art

Known performance data processing apparatuses such as electronic musical instruments, music sequencers, and rhythm machines have such common formats for sound source specification as GM (General MIDI) and XG (extended GM), and may treat automatic performance data formats such as SMF (Standard MIDI File) and DOC (Disk Orchestra). In addition, each particular model has its own unique data sequence format, sound source format, registration data (panel setting data) format, and timbre data format.

In automatic performance, when specifying a type of a sound source format used to reproduce performance data, it is necessary to provisionally embed in the performance data a "GM on" message for the specification of GM system sound source or an "XG on" message for the specification of XG system sound source as an exclusive message code (a data sequence defined by MIDI). When these messages included in the automatic performance data are reproduced and sent to a tone generator of a sound source, the tone generator is made ready for a sound generation mode based on the specified sound source system.

For local formats unique to various commercial products of music players, their exclusive message codes are also provisionally specified in terms of MIDI data sequences. These MIDI data sequences are included in music performance data to comply with the unique requirements of various commercial products.

However, the above-mentioned model messages in MIDI format and other format specifications for sound sources and so on are not standardized. Therefore, there is no generality in input operations of formats. For example, a message unique to a certain machine model and a GM format message are seldom recorded in the form of MIDI formats. These messages are often omitted from data input or otherwise are erroneously inputted. Consequently, in reproducing the performance data, the same may not be properly treated by a specific model of a music machine having a unique reproduction capability, thereby failing the proper reproduction of music.

SUMMARY OF THE INVENTION

It is therefore an object of the present invention to provide a performance data processing apparatus such as an electronic musical instrument, a music keyboard, a music sequencer (including those dedicated to personal computer (PC)), a rhythm machine, and a personal computer having performance data processing capability. This performance data processing apparatus is adapted to interpret performance data and to recognize music control information from auxiliary text data representative of character strings other than music sequence data included in the performance data, the music control information specifying a sound source format, a timbre format, and a product type, for example.

According to the invention, a performance data processing apparatus comprises an input section that inputs performance data containing original music sequence data associated to a music performance and auxiliary text data other than the original music sequence data, a searching section that searches the auxiliary text data to recognize therefrom music control information, and an output section that converts the original music sequence data based on the recognized music control information into final music sequence data effective to reproduce the music performance.

The inventive performance data processing apparatus may further comprises an extracting section that extracts a message code representative of music control information from the original music sequence data. In such a case, the output section converts the original music sequence data based on the extracted message code into the final music sequence data. In a form, the searching section searches the auxiliary text data indicating a source of the inputted performance data so as to recognize the music control information.

In short, the music apparatus having a performance data processing system according to the invention recognizes the music control information from a keyword in the form of character strings such as "GM" other than the music sequence data included in the inputted performance data. On the basis of the music control information represented by the character strings, this system reads the body part or music sequence data part of the performance data, and outputs the reproduced music signal that corresponds to the body part of the performance data. Also, this system can extract music control information in the form of "GM on" message code or else out of the music sequence data included in the inputted performance data. On the basis of the extracted music control information, the system outputs the reproduced music signal. Furthermore, this system can obtain music control information from character strings such as copyright information indicative of a source of the performance data included in the inputted performance data.

This inventive system acquires the music control information indicative of music formats such as sound source specification, model specification, and other music format specifications not only in the direct form of message codes (for example, exclusive MIDI messages) embedded in the music sequence data (a music data part) of the performance data, but also in the indirect form of a keyword denoted by ASCII-based character strings written as comments or else in an auxiliary part outside the music sequence data (for example, in a header part) of the performance data. On the basis of this music control information, this system determines the format of the reproduced music signal. Consequently, even if the format specification message lacks from the music sequence data or contains erroneous information, this system can be adapted to any desired formats.

In the case of music control information dedicated to a specific model of the music performance machines, such information may not be expected for use in reproduction of the performance data by other general models. In such a case, a message code representing the music control information corresponding to that specific model may not be provided in a general data format. However, information such as the name of that model may be included in a comment part or display data part in addition to the music sequence data (music data part) of the performance data. This information can be automatically recognized as the music control information dedicated to that specific model. By use of the automatically recognized control information, the music performance machines of other models can properly treat and process the performance data according to the recognized control information.

BRIEF DESCRIPTION OF THE DRAWINGS

These and other objects of the invention will be seen by reference to the description, taken in connection with the accompanying drawings, in which.

DETAILED DESCRIPTION OF PREFERRED EMBODIMENTS

This invention will be described in further detail by way of example with reference to the accompanying drawings. It should be understood that the following embodiments are illustrative only and therefore various changes and modifications may be made thereto within a sprit and scope of the invention.

Figure 1:
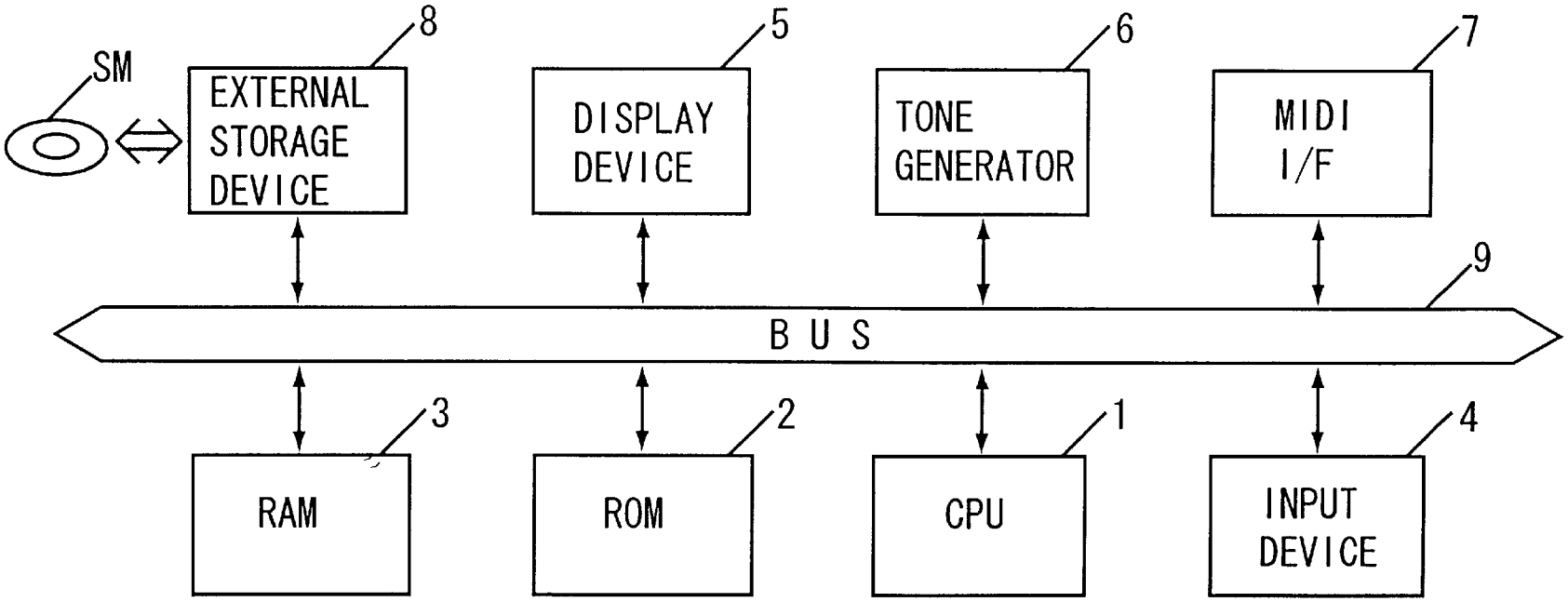
FIG. 1 is a block diagram illustrating hardware construction of a performance data processing apparatus practiced as one preferred embodiment of the invention.

Now, referring to FIG. 1, a performance data processing apparatus according to one embodiment of the invention comprises a central processing unit (CPU) 1, a read-only memory (ROM) 2, a random access memory (RAM) 3, an input device 4, a display device 5, a tone generator 6, a MIDI (Musical Instrument Digital Interface) interface (I/F) 7, and an external storage device 8. These components 1 through 8 are interconnected through a bus 9.

The CPU 1 is provided for controlling the performance data processing apparatus in its entirety, and executes various control operations as instructed by a predetermined computer program. Mainly, the CPU 1 executes the processing of performance data reproduction. The ROM 2 stores one or more predetermined control programs for controlling this data processing apparatus. These programs may include programs for executing basic performance data processing, and other programs, various tables and data associated with preparation of the reproduction operation of the performance data according to the invention. The RAM 3 stores data and parameters necessary for executing these processing operations. The RAM 3 also provides a work area in which various registers and flags and various data being processed are temporarily held.

The input device 4 has operation controls used for setting the control of the system and for setting the capabilities of managing various kinds of performance data such as modes, parameters, and effects. In addition, the input device 4 may have acoustic input means such as a microphone and acoustic input signal processing means. The display device 5 has a monitor screen and various indicators (not shown). These monitor screen and indicators may be arranged on an operator panel along with various operation controls of the input device 4. Conversely, some of the operation controls may be displayed on the monitor screen in the form of an operable graphic user interface. The tone generator 6 generates a music signal representative of reproduced music corresponding to the performance data processed by the apparatus. The tone generator 6 may be configured by either of a hardware device such as a tone generator LSI (Large Scale Integration) or a software program.

The MIDI interface 7 may be coupled to another MIDI apparatus, and provides communication in MIDI format between the performance data processing apparatus and the external MIDI apparatus. The external storage device 8 may be composed of a hard disc drive (HDD), a compact disc read-only memory (CD-ROM) drive, a floppy disc drive, a magneto-optical (MO) disc drive, or a digital versatile disc (DVD) drive. The external storage device 8 stores various control programs and various kinds of data by means of a machine readable medium SM. As clear from the above, the programs and data necessary for the reproduction of performance data may not only be read from the ROM 2 but also be transferred from the external storage device 8 to the RAM 3.

Figure 2:
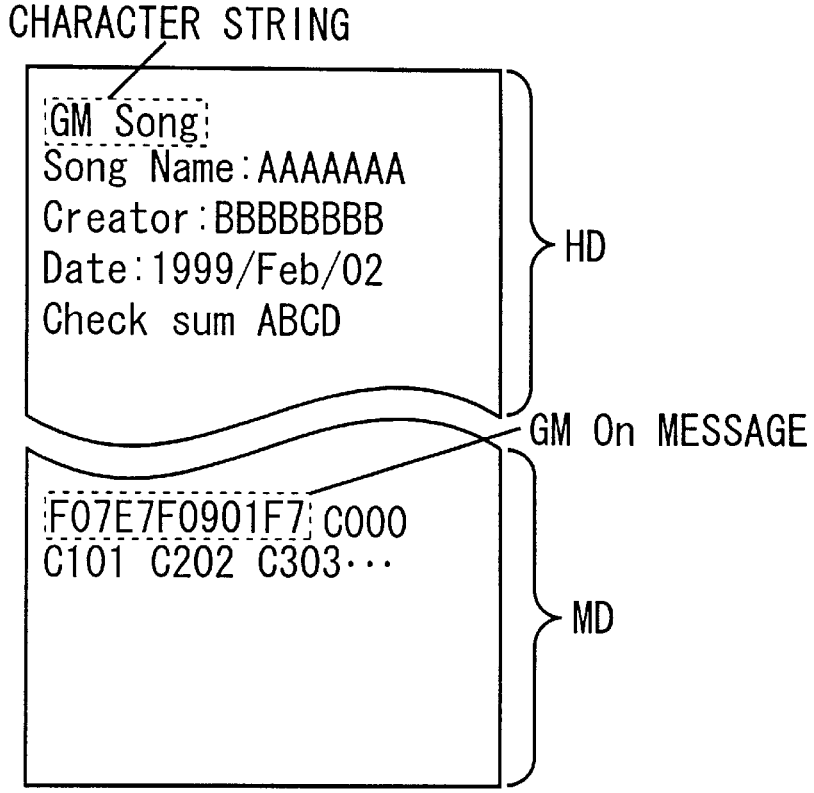
FIG. 2(1) and FIG. 2(2) illustrate examples of performance data formats to which the data processing according to the invention is applied.
Figure 2:
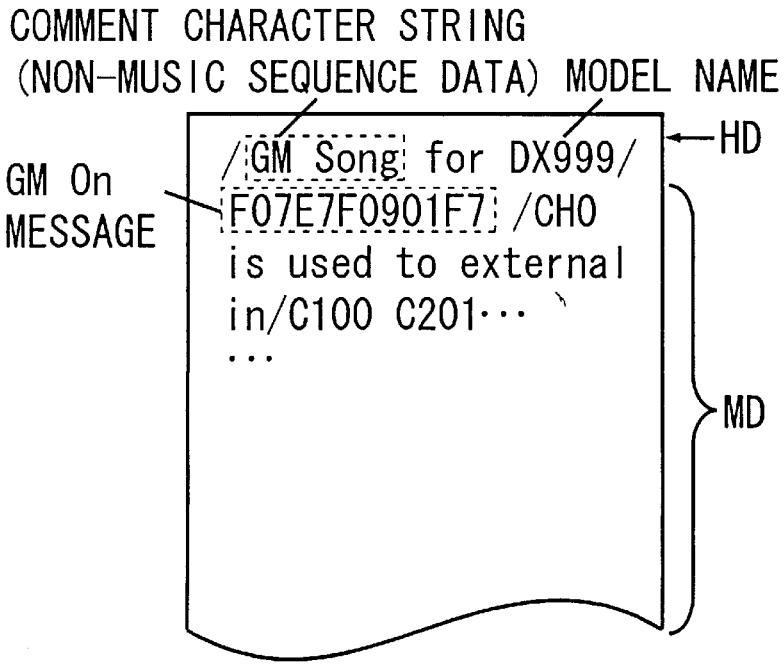

Referring to FIG. 2(1), generally, performance data of many music pieces is composed of a header part HD and a music data part MD. The music data part MD and the header part HD need not be consecutive one after another, or otherwise they may be located in different areas. In general, the music data part is a body part or main part of the performance data, and contains music sequence data that is a series of musical events arranged along progression of music performance to sequentially generate musical tones. On the other hand, the header part contains setup information effective to initialize and configure the tone generator before generating the music tones according to the music sequence data, and contains other index information such as a title of a music piece.

FIG. 2(2) shows another example of performance data. This performance data has a comment (auxiliary text data or non-music sequence data) "GM Song" in its header part HD. In addition, the header part HD indicates a compliance with a specific performance machine product having a model name "DX999". Next comes another message "GM on", followed by a comment indicating assignment of a first channel (CH0) to an external input, which is followed by the body part composed of the music sequence data.

Figure 3:
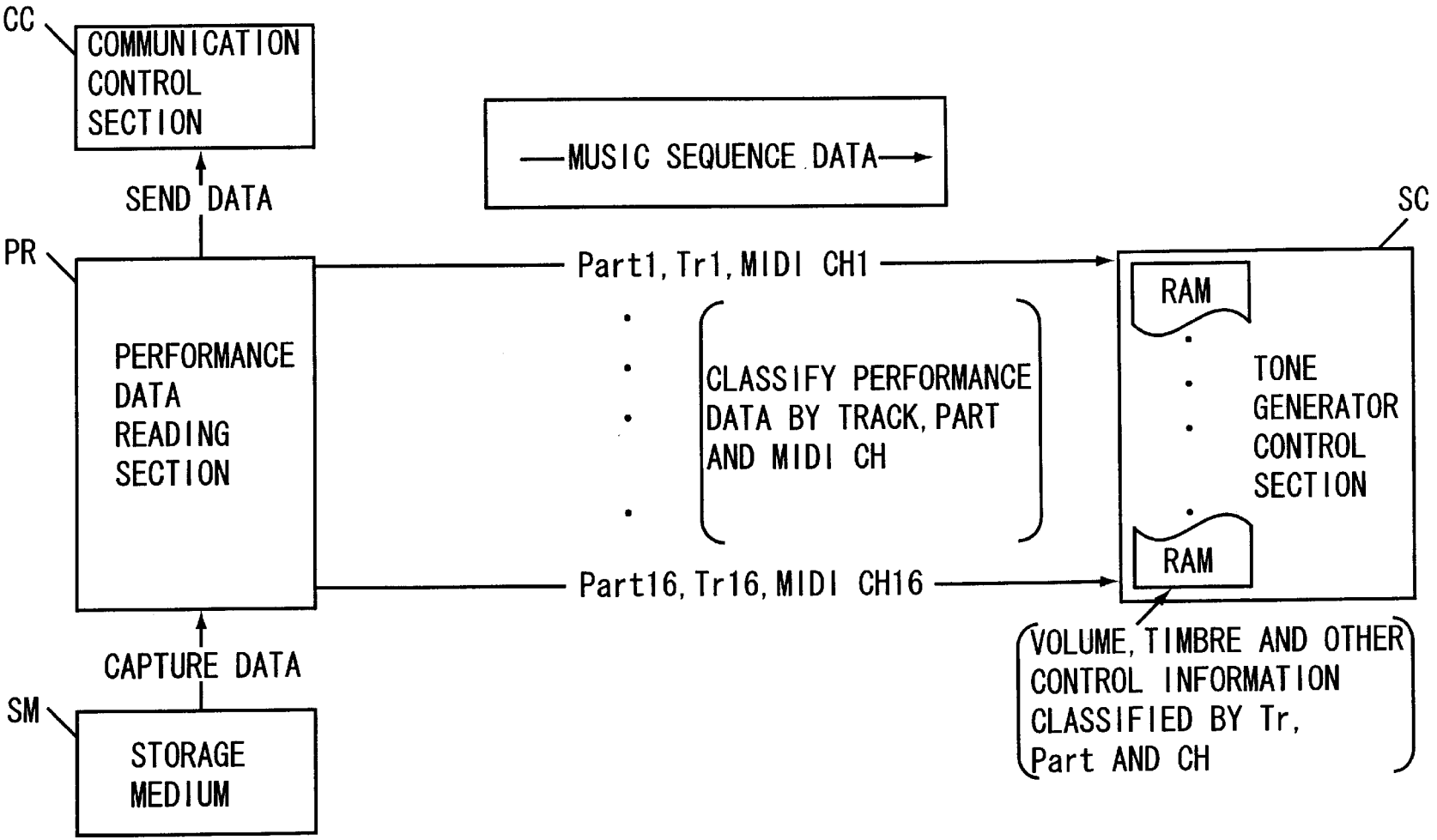
FIG. 3 is a functional block diagram illustrating one example of process flow of performance data in the embodiment shown in FIG. 1.

Referring to FIG. 3, performance data is inputted into a performance data read section PR (having a sequencer capability) from such storage medium SM of the external storage device 8 as HDD, CD-ROM or FD. Normally, the performance data read section PR reads music sequence data from the music data part MD of the captured performance data. The read music sequence data are then sent to a tone generator control section SC. The music sequence data are also sent to a communication control section CC as required. Consequently, the music sequence data are transmitted to another MIDI apparatus through the MIDI interface 7, or transmitted to an external performance data handling apparatus through another communication control section CC not shown.

Normally, the performance data read section PR processes the music sequence data in the music data part MD of the performance data by use of track information (Tr), part information (Part), and channel information (MIDI CH), thereby dividing the performance data into lower levels. The read section PR stores volume, timbre, pitch and other control information into a predetermined storage area of the RAM 3 as classified by track, part, and channel, and passes the performance data to the tone generator control section SC.

In this case, when a message specifying a sound source format such as code "GM on " (F07E7F0901F7) is fed to the tone generator control section SC, the sound source information as classified into track, part, and channel is all changed to predetermined values according to the sound source format specified by this message. This sound source format specification also controls the correlation between a program change message of timbre and a timbre change setting. Then, the tone generator control section SC configures the tone generator 6 to execute the sounding process based on the sound source control information (volume, timbre, and interval) divided by track, part, and channel in matching with the format specification message.

If any format specification message such as code "GM On" is not inputted, the tone generator could not be initialized. Consequently, the volume balance among tracks, parts or channels, and the correlation with other parameters could not be maintained. In addition, a situation might occur in which reception of timbre change command information (namely, program change message) does not lead to the selection of a desired timbre. The present invention avoids these problems by executing control based on the above-mentioned format specification message, thereby providing proper performance of music based on the music sequence data contained in the body part MD of the performance data.

Figure 4:
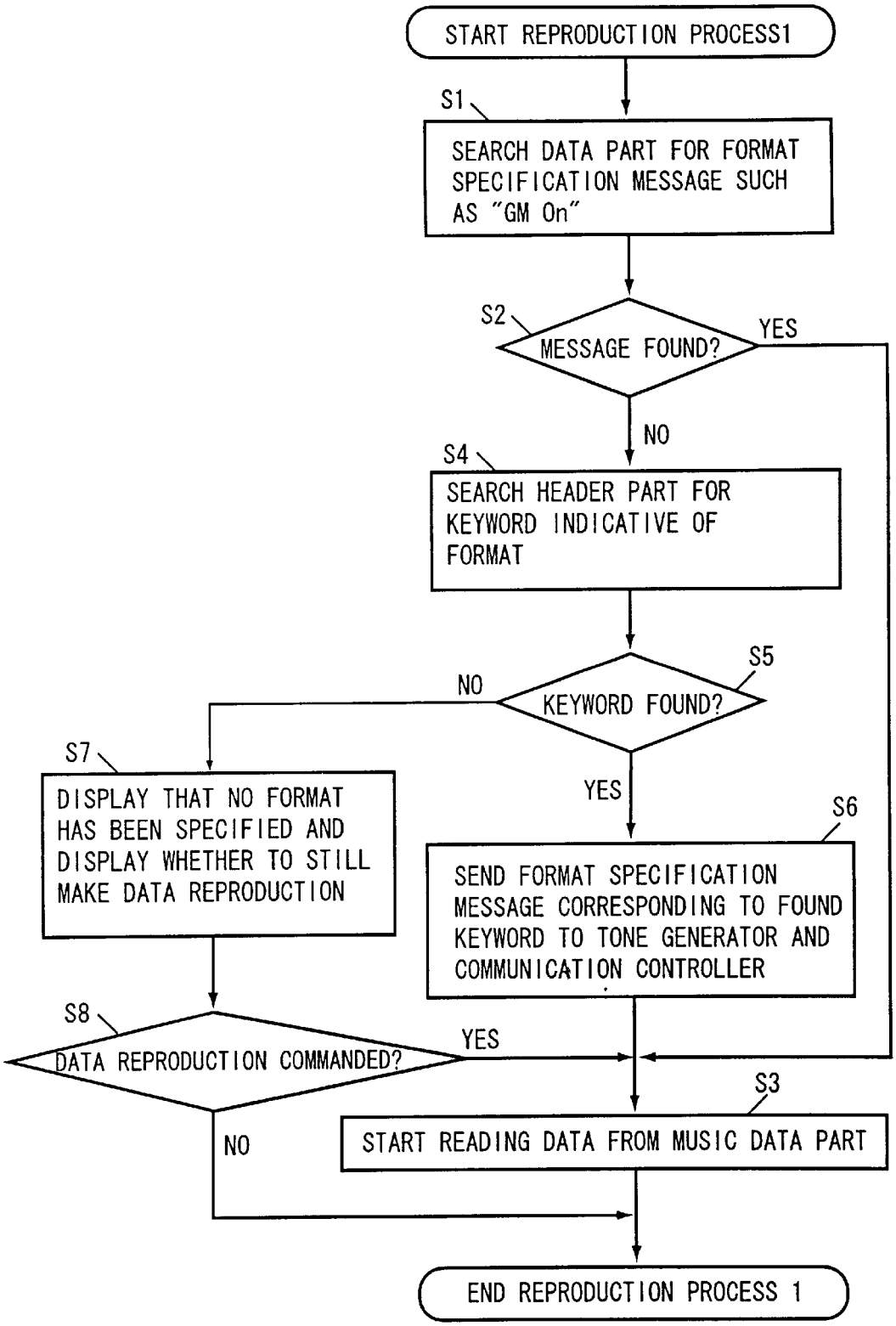
FIG. 4 is a flowchart indicative of performance data reproduction process 1 according to the embodiment shown in FIG. 1.

Referring to FIG. 4, the processing flow 1 is applicable to the performance data that have the header part HD and the music data part MD as shown in FIG. 2(1). In step S1 of this processing flow 1, the CPU 1 searches the music data part MD of the performance data for a format specification message such as "GM On" message code. If such a message is found in step S2, then, in step S3, the CPU 1 immediately starts the processing of reading sequence data from the music data part MD. If no such message code is found, control is passed to step S4.

In step S4, the CPU 1 searches text data of the header part HD for a keyword such as "GM". In step S5, if such a keyword is found, then, control is passed to step S6. Otherwise, control is passed to step S7. In step S6, the CPU 1 sends a format specification message code corresponding to the keyword character string "GM" to the tone generator control section SC or the communication control section CC. Then, control returns to step S3, in which the CPU 1 starts the processing of reading the music sequence data from the music data part MD.

On the other hand, in step S7, the CPU 1 indicates on the display device 5 a warning that no control information has been found and, at the same time, displays a message "if make reproduction or not". In step S8, the CPU 1 determines whether the user has given a command for the data reproduction in response to this warning message. If the data reproduction has been commanded, then control is returned to step S3, in which the CPU 1 starts the processing of reading the sequence data from the music data part MD. Otherwise, the CPU 1 ends this processing flow 1.

In the processing flow 1, the performance data including the music sequence data for "GM" sound source as shown in FIG. 2(1) is processed, for example. If the "GM On" message code is incidentally omitted from the music data part MD, then, in step S4, the CPU 1 causes the performance data read section PR to search the header part HD of the performance data for a keyword or format specifying character string. If a character string "GM Song" is found in the header part HD, the CPU 1 accordingly generates and passes the "GM On" message to the tone generator control section SC or to an externally connected device through the communication control section CC (step S6). Thus, even if message code "GM On" is not embedded in the performance data, the present system can support the GM format by detecting a substitute keyword. Namely, the tone generator 6 can execute tone generation process based on control information in matching with the control message, and can properly generate musical tones according to the music sequence data read out from the body part MD of the performance data.

Referring back again to FIGS. 1 and 3, the inventive music apparatus is constructed for providing a music performance according to performance data. In the music apparatus, an input section such as MIDI interface 7 and the external storage device 8 inputs performance data composed of a header part HD and a body part MD containing music sequence data associated to a music performance. The searching section implemented by CPU 1 searches the header part HD of the performance data to find therefrom a keyword. The reading section PR provides music control information corresponding to the keyword searched from the header part HD. A generator section or tone generator 6 processes the music sequence data contained in the body part MD of the inputted performance data based on the music control information provided from the reading section PR to thereby output a signal representative of the music performance. In detail, the reading section PR reads out an original form of the music sequence data from the body part MD of the performance data. The control section SC converts the original form of the music sequence data read out from the body part MD into a modified form of the music sequence data according to the music control information provided from the reading section PR, so that the tone generator 6 processes the modified form of the music sequence data fed from the control section SC.

Practically, the searching section searches a message code representative of music control information from the body part MD of the performance data and provides the message code if present in the body part MD to the tone generator 6. Otherwise, the searching section operates when the message code is absent from the body part MD for searching the keyword from the header part HD in place of an absent message code. The music apparatus may further include an indicating section such as the display device 5 that indicates a warning when the searching section fails to find a keyword. For example, the searching section searches a keyword indicative of music control information which specifies a format of the music sequence data so as to enable the tone generator 6 to process the music sequence data. Normally, the searching section searches a keyword in the form of a character string indicating a format of the performance data.

Further, The machine-readable medium SM may be used in the music apparatus having the CPU 1. Namely, the medium SM may contain program instructions executable by the CPU 1 for causing the music apparatus to carry out a process of providing a music performance according to performance data. The process is carried out by the steps of inputting or providing performance data containing music sequence data associated to a music performance, searching the performance data to find therefrom a keyword, providing music control information corresponding to the keyword searched from the performance data, and processing the music sequence data contained in the inputted performance data according to the provided music control information to output a signal representative of the music performance.

Figure 5:
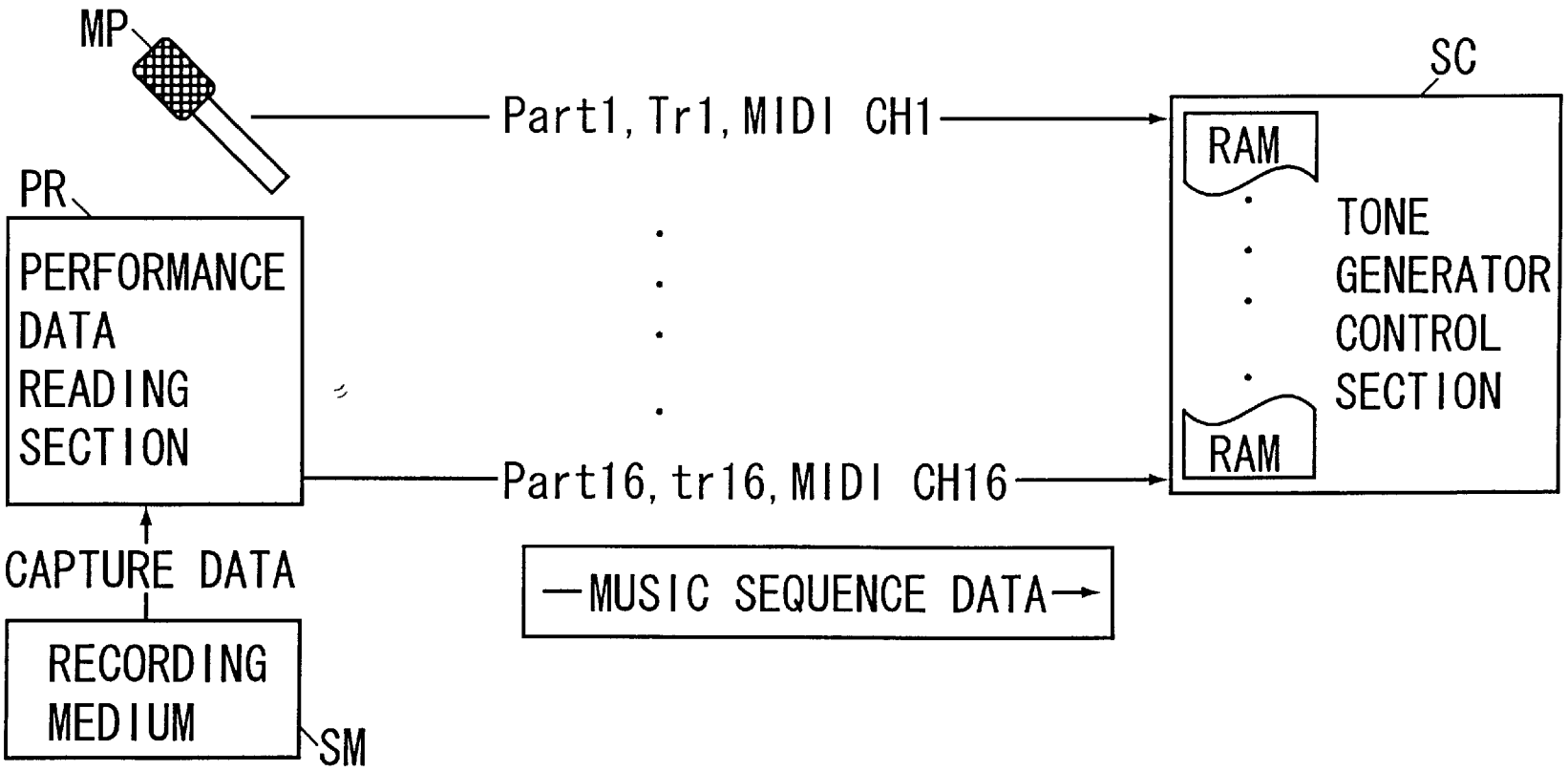
FIG. 5 is a functional block diagram illustrating process flow of performance data in another embodiment of the invention.

Referring next to FIG. 5, a music performance machine product of model name "DX999" for example handles performance data as described with reference to FIG. 2(2). This product "DX999" uses a sound source part 1 always as a channel for an external microphone input. Special settings of microphone DSP and volume control are made only on this channel. Sometimes, these special settings are automatically executed at the power-on sequence of the machine product "DX999".

On the other hand, the performance data processing apparatus practiced as this embodiment is assumed to have the input device 4 including an acoustic input signal processing means that converts a voice signal inputted from an acoustic input means MP such as a microphone into voice data of a predetermined format. Also, this performance data processing apparatus is assumed to provide a sound source capacity equivalent to that of the above-mentioned music performance machine model. The performance data dedicated to the model "DX999" have a specific data structure as shown in FIG. 2(2). The performance data are inputted into the performance data read section PR from the storage medium SM in which the performance data are stored.

Assume here that the music sound signal is reproduced by feeding the performance data read section PR with the unique performance data dedicated to "DX999" and stored in the storage medium SM. In this case, the special setting for the sound source part 1 is not inserted in the dedicated performance data because the music apparatus of the model "DX999" is inherently initialized by the special setting for the sound source part 1. In such a case, the inventive apparatus different than the model "DX999" can properly treat the dedicated performance data by the reproduction processing having the keyword character string search and format setting capabilities. Namely, the performance data of the first sound source part (part1) are sent from the above-mentioned acoustic input means MP to the tone generator control section SC through the acoustic input signal processing means as with the product "DX999", and the performance data of other parts are sent to the tone generator control section SC. Thus, the present invention can cope with the performance data unique to the specific model in question.

Figure 6:
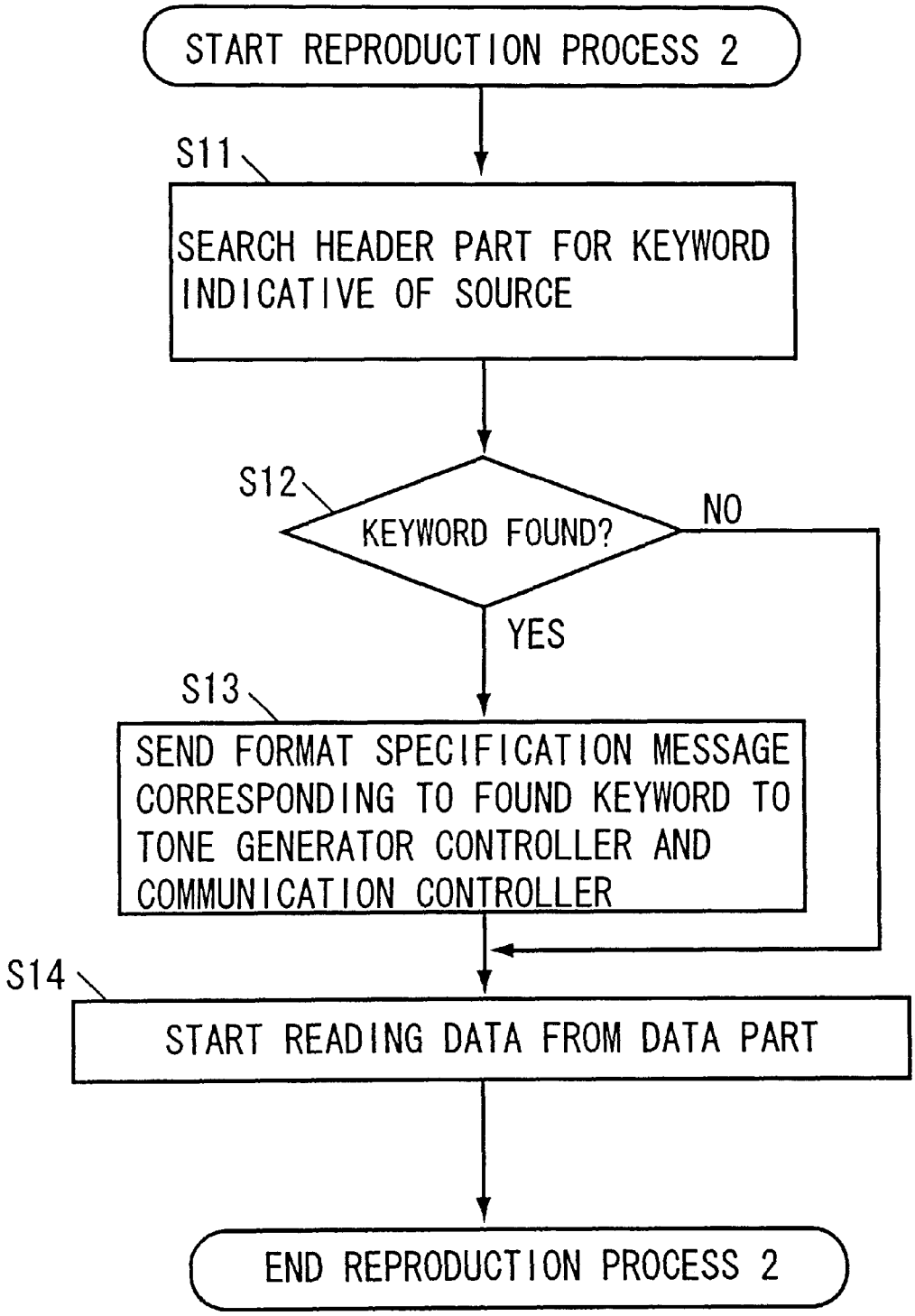
FIG. 6 is a flowchart indicative of performance data reproduction process 2 according to the embodiment shown in FIG. 5.

Referring to FIG. 6, the reproducing flow 2 is applied to a situation in which performance data with a particular part setting unique to a certain product model are made available for another product model having an equivalent sound source capacity. In step S11, the CPU 1 searches the header part HD of the performance data for a keyword character string indicative of a source of the performance data. If such a keyword character string is found in step S12, control is passed to step S13. Otherwise, control is passed to step S14. In step S13, the CPU 1 sends a format specification message corresponding to the keyword character string to the tone generator control section SC, upon which control is passed to step S14. In step S14, the CPU 1 starts the processing of reading the sequence data from the music data part MD.

If the performance data processing apparatus has a sound source capacity equivalent to that of a certain product model and attempts to use the performance data with particular part setting specific to the product model "DX999" as shown in FIG. 2(2) and FIG. 5 for example, no explicit part setting information is embedded in the performance data. In such a case, the processing flow 2 is applied. To be more specific, by use of a keyword such as "DX999" or "999", the CPU 1 searches the performance data area other than the music sequence data for a specific character string (step S11). If the character string is found, the CPU 1 sends the corresponding format specification message to the tone generator control section SC (step S13). Thus, the inventive generic apparatus can cope with any specific case.

In the above case, the setting information which is identical or resembling to the part setting of the product model in question ("DX999") is stored beforehand in the ROM 2 for example in correspondence with the keyword character string ("DX999" or "999") so as to enable the inventive system to simulate the specific model "DX999". When the keyword character string is found, this setting information is read as a format specification message. On the basis of this setting information, the music data part MD is processed to reproduce the music sound signal. In the case shown in FIG. 2(2) and FIG. 5, the part 1 setting information of the product model "DX999" may be sent for part 1 after setting "GM On" of the music data part MD.

Referring back again to FIG. 5, the searching section detects a keyword indicative of music control information which specifies a source of the performance data, and the control section SC configures the tone generator 6 for complying the same to requirements provided from the specified source of the performance data. In such a case, the reading section PR includes a table memory that registers a plurality of items of the music control information in correspondence to a plurality of keywords for selecting one item of the music control information corresponding to the detected keyword.

In each of the above-mentioned embodiments, the performance data read section PR having the sequencer capability and the tone generator control section SC having the sound source control capability are implemented by combination of the CPU 1, the ROM 2, and the RAM 3. Alternatively, the tone generator control section SC may be incorporated into the tone generator 6. Alternatively again, a sequencer having the processing capability of the performance data read section PR may be combined with a tone generator having the processing capability of the tone generator control section SC into a performance data processing apparatus. The hardware configuration of this performance data processing apparatus may take any desired form.

In the above-mentioned embodiments, the music control information is recognized by searching data areas such as the header part HD other than the music sequence data in the performance data for each music so as to detect a format-indicative keyword character string such as "GM". Alternatively, auxiliary locations such as a beginning part, a table of contents, an interval between songs, and an ending other than the performance data for each music may be searched for a character string indicative of a performance data source. For example, a model ID or a product manufacturer may be identified from a copyright character string in order to determine a proper format from the identified model ID information or product manufacturer information or in order to complement insufficient format setting data. If there are variations in "GM" between product manufacturers, this complementation allows data setting for the difference between product manufacturers by use of information "GM" character string (or "GM On" message) plus manufacturer copyright indication. Namely, the reading section PR provides supplemental music control information based on the keyword searched from the header part such that the supplemental music information may supplement a deficiency of the performance data initially inputted by the input section such as MIDI interface 7.

Preferably, plural keyword search character string candidates are prepared. For example, in the case of GM system, character strings such as "GM", "GM Song", "General MIDI" are prepared. Setting modes classified by channel, part, and track and message codes to be outputted when one of these character string is found are registered into a table, which is provided in the ROM, RAM, or other storage areas. This arrangement enhances the efficiency of the data processing.

As described and according to the invention, the music control formats for sound source specification, model specification, and other music format specifications are determined by considering not only specification MIDI message codes prescribed in the performance data but also keywords in the form of normal ASCII code character strings written as comments in the performance data. This novel arrangement allows the performance data processing apparatus to cope with any desired format even if there is an omission or an error in inputting a format specification message.

Furthermore, in the case of control information dedicated to a certain music performance product model, namely, control information not especially expected for the data reproduction on machine products of other models, a message code corresponding to the specific model may not be inputted into a predetermined data format. Even in such a situation, if the information about the name of the product model in question is included in a comment in the performance data or in associated display data, the information can be automatically recognized as the keyword indicative of the specific model. Consequently, the products of other models can use the dedicated data to cope with desired formats.

While the preferred embodiments of the present invention have been described using specific terms, such description is for illustrative purposes only, and it is to be understood that changes and variations may be made without departing from the spirit or scope of the appended claims.

What is claimed is:

1. A music apparatus for providing a music performance according to performance data, comprising:

an input section that inputs performance data composed of a header part and a body part containing music sequence data associated to a music performance;

a searching section that searches the header part of the performance data to find therefrom a keyword;

a reading section that provides music control information corresponding to the keyword searched from the header part; and a generator section that processes the music sequence data contained in the body part of the inputted performance data based on the music control information provided from the reading section to thereby output a signal representative of the music performance.

2. The music apparatus according to claim 1, wherein the reading section reads out an original form of the music sequence data from the body part of the performance data, the music apparatus further comprising a control section that converts the original form of the music sequence data read out from the body part into a modified form of the music sequence data according to the music control information provided from the reading section, so that the generator section processes the modified form of the music sequence data fed from the control section.

3. The music apparatus according to claim 1, wherein the searching section searches a message code representative of music control information from the body part of the performance data and provides the message code if present in the body part to the generator section, and otherwise the searching section operates when the message code is absent from the body part for searching the keyword from the header part in place of an absent message code.

4. The music apparatus according to claim 1, further comprising an indicating section that indicates a warning when the searching section fails to find a keyword.

5. The music apparatus according to claim 1, wherein the searching section searches a keyword indicative of music control information which specifies a format of the music sequence data so as to enable the generator section to process the music sequence data.

6. The music apparatus according to claim 1, wherein the searching section searches a keyword in the form of a character string indicating a format of the performance data.

7. The music apparatus according to claim 1, wherein the searching section searches a keyword in the form of a character string indicating a model name of a machine designed to process the performance data.

8. The music apparatus according to claim 1, wherein the searching section searches a keyword in the form of a character string indicating a copyright of the performance data inputted from the input section.

9. The music apparatus according to claim 1, wherein the reading section includes a table memory that registers a plurality of items of the music control information in correspondence to a plurality of keywords for selecting one item of the music control information corresponding to the found keyword.

10. The music apparatus according to claim 1, wherein the reading section provides supplemental music control information based on the keyword searched from the header part such that the supplemental music control information may supplement a deficiency of the performance data initially inputted by the input section.

11. A music apparatus for providing a music performance according to performance data, comprising:

an input section that inputs performance data containing music sequence data associated to a music performance;

a searching section that searches the performance data to find therefrom a keyword;

a reading section that provides music control information corresponding to the keyword searched from the performance data; and a generator section that processes the music sequence data contained in the inputted performance data according to the music control information provided from the reading section to thereby output a signal representative of the music performance.

12. The music apparatus according to claim 11, wherein the searching section searches a keyword involved in the form of a character string.

13. The music apparatus according to claim 11, wherein the input section inputs performance data composed of a main part allotted to the music sequence data and an auxiliary part allotted to data other than the music sequence data, and wherein the searching section searches the auxiliary part of the performance data to find therefrom a keyword.

14. A performance data processing apparatus comprising:

an input section that inputs performance data containing original music sequence data associated to a music performance and auxiliary text data other than the original music sequence data;

a searching section that searches the auxiliary text data to recognize therefrom music control information; and an output section that converts the original music sequence data based on the recognized music control information into final music sequence data effective to reproduce the music performance.

15. The performance data processing apparatus according to claim 14, further comprising an extracting section that extracts a message code representative of music control information from the original music sequence data, wherein the output section converts the original music sequence data based on the extracted message code into the final music sequence data.

16. The performance data processing apparatus according to claim 14, wherein the searching section searches the auxiliary text data indicating a source of the inputted performance data so as to recognize the music control information.

17. A music apparatus for providing a music performance according to performance data, comprising:

input means for inputting performance data composed of a header part and a body part containing music sequence data associated to a music performance;

searching means for searching the header part of the performance data to find therefrom a keyword;

reading means for providing music control information corresponding to the keyword searched from the header part; and generator means for processing the music sequence data contained in the body part of the inputted performance data based on the music control information provided from the reading means to thereby output a signal representative of the music performance.

18. A performance data processing apparatus comprising:

input means for inputting performance data containing original music sequence data associated to a music performance and auxiliary text data other than the original music sequence data;

searching means for searching the auxiliary text data to recognize therefrom music control information; and output means for converting the original music sequence data based on the recognized music control information into final music sequence data effective to reproduce the music performance.

19. A method of providing a music performance according to performance data, comprising the steps of:

inputting performance data composed of a header part and a body part containing music sequence data associated to a music performance;

searching the header part of the performance data to find therefrom a keyword;

providing music control information corresponding to the keyword searched from the header part; and processing the music sequence data contained in the body part of the inputted performance data according to the provided music control information to thereby output a signal representative of the music performance.

20. The method according to claim 19, wherein the providing step reads out an original form of the music sequence data from the body part of the performance data, the method further comprising the step of converting the original form of the music sequence data read out from the body part into a modified form of the music sequence data according to the music control information, so that the processing step processes the modified form of the music sequence data.

21. A method of providing a music performance according to performance data, comprising the steps of:

inputting performance data containing music sequence data associated to a music performance;

searching the performance data to find therefrom a keyword;

providing music control information corresponding to the keyword searched from the performance data; and processing the music sequence data contained in the inputted performance data based on the provided music control information to thereby output a signal representative of the music performance.

22. A method of processing performance data comprising the steps of:

inputting performance data containing original music sequence data associated to a music performance and auxiliary text data other than the original music sequence data;

searching the auxiliary text data to recognize therefrom music control information; and converting the inputted original music sequence data based on the recognized music control information into final music sequence data effective to reproduce the music performance.

23. A medium for use in a music apparatus having a processor, the medium containing program instructions executable by the processor for causing the music apparatus to carry out a process of providing a music performance according to performance data, wherein the process comprises the steps of:

inputting performance data composed of a header part and a body part containing music sequence data associated to a music performance;

searching the header part of the performance data to find therefrom a keyword;

providing music control information corresponding to the keyword searched from the header part; and processing the music sequence data contained in the body part of the inputted performance data based on the provided music control information to thereby output a signal representative of the music performance.

24. The medium according to claim 23, wherein the providing step reads out an original form of the music sequence data from the body part of the performance data, and wherein the process further comprises the step of converting the original form of the music sequence data read out from the body part into a modified form of the music sequence data according to the music control information, so that the processing step processes the modified form of the music sequence data.

25. A medium for use in a music apparatus having a processor, the medium containing program instructions executable by the processor for causing the music apparatus to carry out a process of providing a music performance according to performance data, wherein the process comprises the steps of:

inputting performance data containing music sequence data associated to a music performance;

searching the performance data to find therefrom a keyword;

providing music control information corresponding to the keyword searched from the performance data; and processing the music sequence data contained in the inputted performance data according to the provided music control information to output a signal representative of the music performance.

26. A medium for use in a performance data processing apparatus having a processor, the medium containing program instructions executable by the processor for causing the performance data processing apparatus to carry out a process comprising the steps of:

inputting performance data containing original music sequence data associated to a music performance and auxiliary text data other than the original music sequence data;

searching the auxiliary text data to recognize therefrom music control information; and converting the inputted original music sequence data based on the recognized music control information into final music sequence data effective to reproduce the music performance.

* * * * *